United States Patent [19]

Tolliver et al.

[11] 4,313,381

[45] Feb. 2, 1982

[54] MOORING SYSTEM

[75] Inventors: Daniel R. Tolliver, Laurel; W. Gordon Haug, Bethesda, both of Md.

[73] Assignee: The United States of America as represented by the Secretary of the Navy, Washington, D.C.

[21] Appl. No.: 97,269

[22] Filed: Nov. 26, 1979

[51] Int. Cl.[3] ..... F42B 22/18

[52] U.S. Cl. ..... 102/413; 102/414

[58] Field of Search ..... 102/412–414, 102/13, 14, 10

[56] References Cited

U.S. PATENT DOCUMENTS

| | | | |
|---|---|---|---|
| 947,230 | 1/1910 | Gabriel | 102/13 |
| 1,154,272 | 9/1915 | Senger et al. | 102/13 |
| 1,542,543 | 6/1925 | Elia | 102/13 |
| 1,546,921 | 7/1925 | Elia | 102/13 |
| 1,670,079 | 5/1928 | Pratt | 102/13 |
| 2,352,226 | 6/1944 | Ronning | 102/14 |
| 2,706,948 | 4/1955 | Turlay | 102/13 |
| 3,195,460 | 7/1965 | Kalaf | 102/14 |
| 3,648,611 | 3/1972 | Noel | 102/13 |
| 3,696,747 | 10/1972 | Kissinger | 102/10 |
| 3,772,639 | 11/1973 | Snyder | 102/13 |

*Primary Examiner*—Charles T. Jordan

*Attorney, Agent, or Firm*—R. S. Sciascia; A. L. Branning; W. R. Henderson

[57] ABSTRACT

A system for mooring a buoyant case such as a marine mine or other marine device at a preselected depth below the surface of the water in which the case was launched. After the case has been launched, and made bottom contact, the mooring system utilizes a first piston assembly in conjunction with a corrodible pin to initiate mooring line payout from a buoyant case to an attached anchor. When the preselected mooring depth is reached, a second piston assembly terminates the mooring line payout and the ascent of the case, thereby resulting in mooring of the buoyant case at the preselected depth.

25 Claims, 8 Drawing Figures

MOORING SYSTEM

BACKGROUND OF THE INVENTION

The present invention relates to a mooring system for mooring a marine device at a preselected depth, and more particularly to a mooring system for mines.

Marine mines and other marine devices are launched from airborne platforms, submarines or surface ships. The physical limitation of each type of launch facility limits the overall weight and size of a combined anchor, mine and mooring mechanism. It is thus evident that a reliable, compact and lightweight mooring mechanism will permit either a greater amount of ordnance to be carried on each individual mine, thus increasing the effectiveness of the mine, or a greater number of mines or other marine devices to be carried and launched from the launching facility, thus increasing the effectiveness of the launching facility.

Prior art mooring systems include devices wherein a plummet line is connected to a mine which serves as a guide for the anchor to ride down to the ocean floor. The anchor is equipped with a hydrostatic gripper which is set to actuate at a selected depth thereby gripping the plummet line and pulling the mine down to a predetermined depth.

Devices have also been proposed in which a hydrostat is attached to the mooring line near the buoyant case so as to form a bight in the line which is not subject to the tension created by the anchor. As the anchor descends and reaches a set depth the hydrostat is actuated by the increased water pressure which causes the bight in the mooring line to be released. The momentary release of tension on the mooring line acts as a signal to a drum to cease payout of the mooring line.

Other devices have been proposed whereby the entire buoyant case and anchor sink to the ocean floor and the case is then released to ascend to the selected depth. A hydrostat attached to the case senses the selected depth and signals a mooring line drum on the anchor to cease payout of the mooring line.

The major disadvantage of the prior art devices is that they employ rotating mooring line drums with braking components so as to permit paying out of the mooring line. Because the rotating drums and brakes have been located on the anchors, which descend to the ocean floor, the drum and brake components have required structural strengthening to withstand the greater pressures found at the anchor depth, as opposed to tht lesser pressure found at the mooring depth. This results in a massive drum and brake structure which requires either a more massive device overall or, where the device is a mine, less ordnance carried by an individual mine.

Another disadvantage of the prior art devices is that the rotating drums and braking components of the mooring systems are mechanically complex in nature and are therefore subject to mechanical failures.

SUMMARY OF THE INVENTION

Accordingly, in the present invention an improved mooring system is attained by providing a buoyant case, an anchor, a resilient line connected to the anchor, a mooring line attached at one end to a non-rotating storage spool in the case and connected at the other end in series with the resilient line, and two hydrostatically retractible piston assemblies, the first of which permits the resilient line to be released from the mine case when a first preselected depth is passed and the second of which activates the braking pin for stopping the mooring line payout when the mooring depth is reached.

The case and anchor are detachably secured by a retaining band. The ends of the retaining band are secured by an explosive bolt. At a designated depth the explosive bolt is detonated by a command signal, originating in the mechanism of the device itself, allowing the case and anchor to separate.

The anchor is connected to the case by a resilient line which allows the anchor and case to separate to the extent of the resilient line length, and then both the case and anchor descend to the bottom. The resilient line is releasably connected to the case by both a corrodible pin and a first hydrostatically retractible piston assembly. The resilient line is also connected in series with the mooring line which is stored on a non-rotating storage spool in the case. As the anchor and case sink to the bottom, they pass through a first preselected depth where a first piston assembly is hydrostatically actuated to release the resilient line from the mine case. The resilient line is still connected to the case by the corrodible pin.

After the anchor reaches the ocean floor the corrodible pin dissolves under the action of the seawater, thus releasing the resilient line from the case and permitting the mooring line to payout from the non-rotating storage spool. With payout of the mooring line, the case ascends until a second preselected depth, the mooring depth, is reached. At the mooring depth a second piston assembly is hydrostatically actuated to release a spring biased braking pin which terminates further payout of the mooring line.

If the actual water depth is less than the first preselected depth the first piston is never actuated and the case will be moored only by the resilient line which remains secured to the case, even after the corrodible pin has dissolved.

OBJECTS OF THE INVENTION

It is therefore an object of the present invention to provide a mooring mechanism that is structurally simple, reliable, compact and lightweight.

Another object is to provide a mooring mechanism which can be deployed from a surface, submerged or aerial platform and automatically moor a mine or other marine device at a preselected mooring depth.

Another object is to provide a mooring mechanism that begins the payout of resilient mooring line before the anchor reaches the ocean floor.

Yet another object is to provide a mooring mechanism that can withstand the sudden shock and oscillation associated with the termination of mooring line payout.

Still another object is to provide a mooring mechanism which allows time delayed payout of mooring line after passing a first preselected depth and terminates further payout of mooring line at a second preselected depth.

A further object is to provide a mooring mechanism that eliminates rotating parts and attendant braking structure.

Other objects, advantages and novel features of the present invention will become apparent from the following detailed description of the invention when considered in conjunction with the accompanying drawings.

BRIEF DESCRIPTION OF THE DRAWINGS

A more complete appreciation of the invention and many of the attendant advantages thereof will be readily understood by reference to the following detailed description when considered in conjunction with the accompanying drawings in which like reference numerals designate like parts throughout the figures and wherein.

DESCRIPTION OF THE PREFERRED EMBODIMENTS

Figure 1:
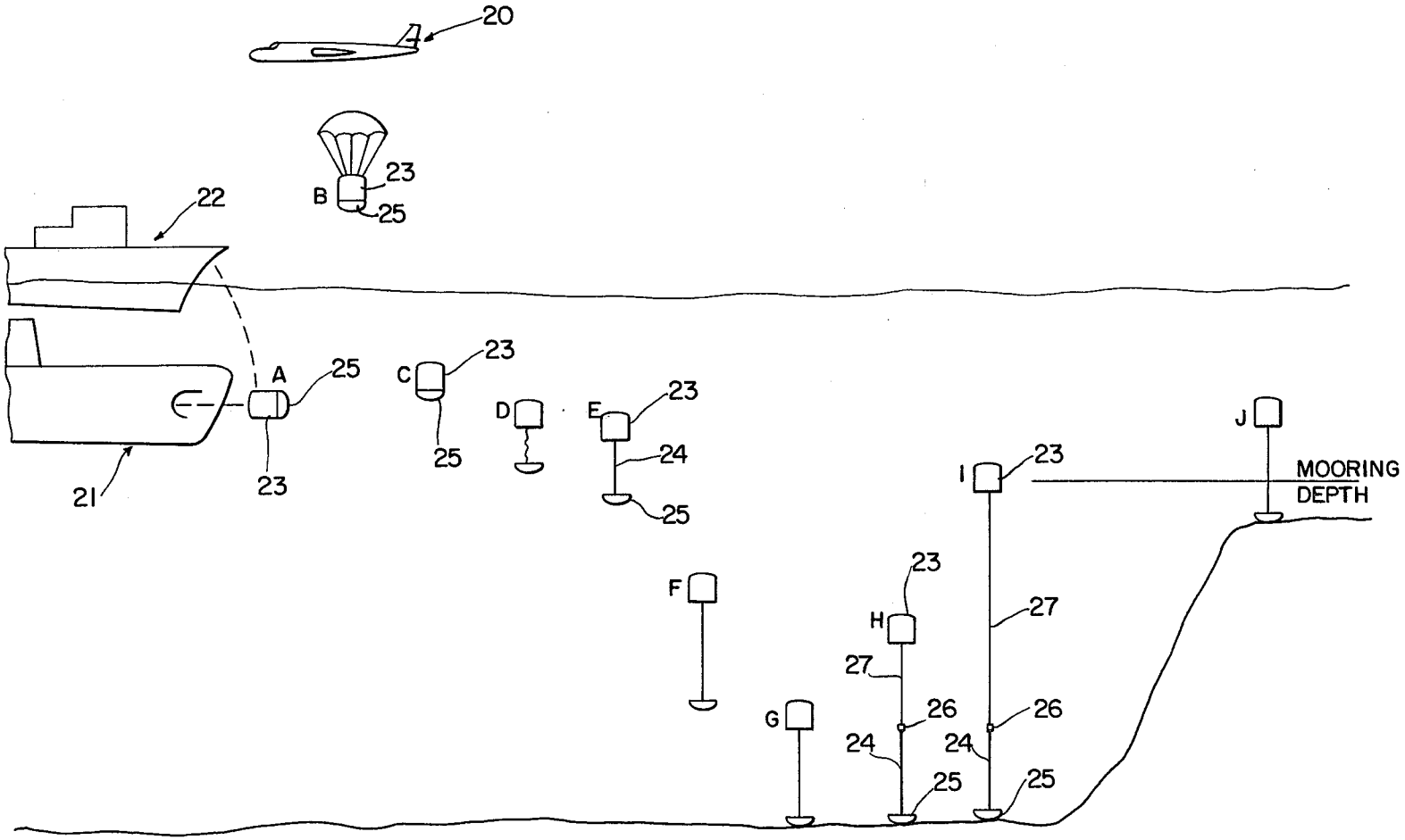
FIG. 1 shows in diagrammatic form the mooring sequence of the mine mooring system according to the present invention.

Referring now to FIG. 1, there is shown in diagrammatic form a marine device such as a mine having a case 23 and an anchor 25 detachably secured thereto at the moment of being released from aircraft 20, submarine 21 or surface ship 22. The position of the case 23 and anchor 25 in the water after being released from submarine 21 or surface ship 22 is indicated at position A. The position of the air deployed case is indicated at B. The relative position of case 23 and anchor 25 during the subsequent movement thereof through the water until the mine is moored at a preselected depth is indicated generally by the positions designated C through I. If the depth of the water in which the case is launched is less than the first preselected depth, the mooring sequence is indicated generally by A or B for surface, submarine or air deployed mines, respectively, and then C, D, E and J.

Anchor 25 and case 23 are preferably cylindrical in shape so as to facilitate launching from a torpedo tube and may be constructed of light weight materials such as aluminum or other metal. The anchor and case are detachably secured at their mating end faces 34 and 35 so as to form a cylindrical unit, see FIG. 2.

Figure 2:
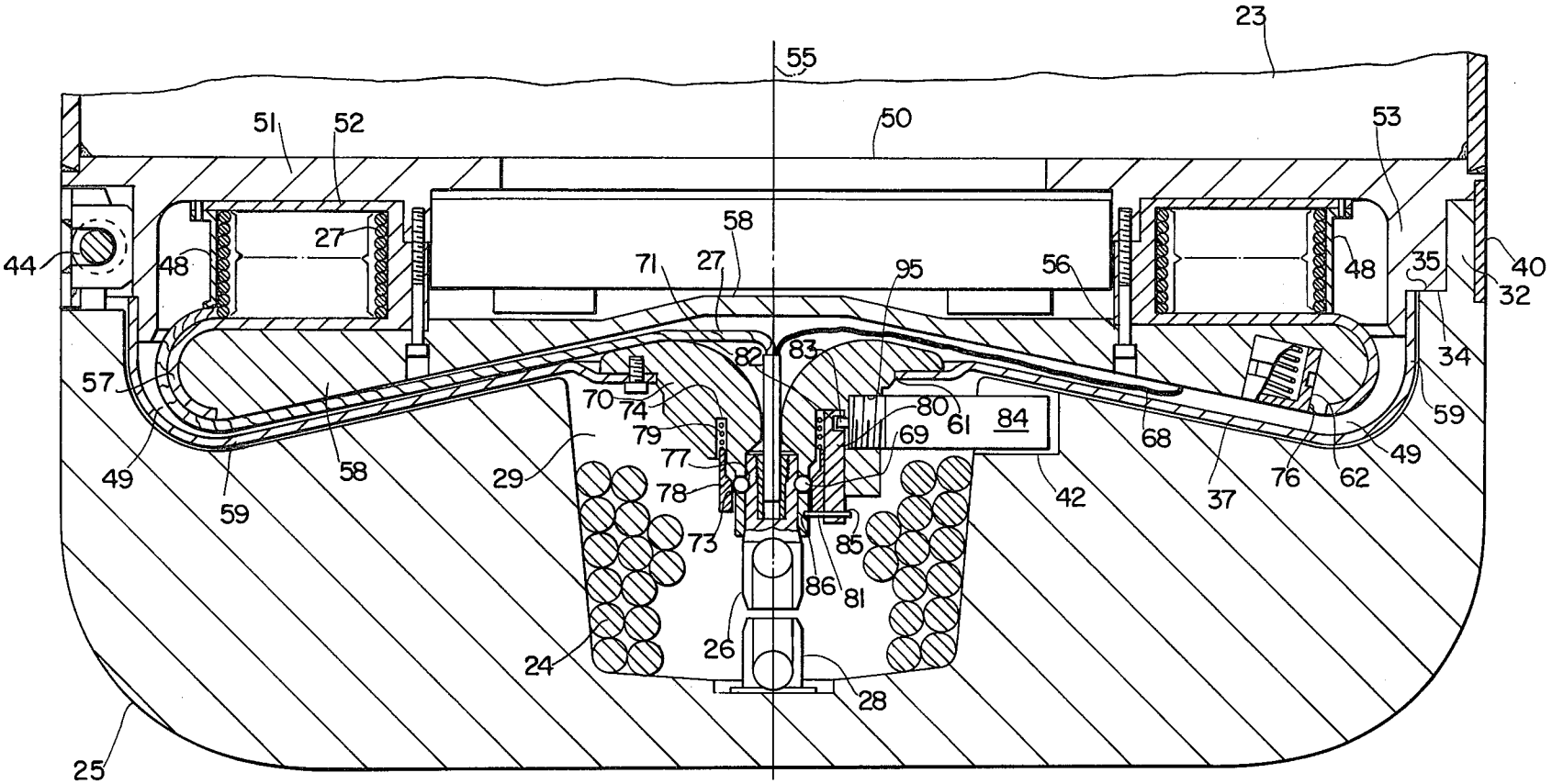
FIG. 2 shows a longitudinal cross-section of the anchor and mooring system mounted on the mine case.
Figure 4:
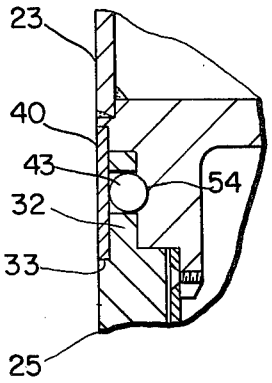
FIG. 4 shows a longitudinal cross-section of the retaining band for securing the anchor to the case.

Referring to FIG. 2, the mine sinks through the water with case 23 uppermost. Anchor 25 is detached from case 23 by explosive bolt 44 which releases retaining band 40 allowing a plurality of balls 43 to move out of groove 54, shown in FIG. 4, causing case and anchor to separate thereby withdrawing a resilient line 24, such as nylon or other suitable material, from a recessed cavity 29 in the mating end 34 of the anchor. Resilient line 24 is connected at one end by fitting 28 to the center of anchor 25. The other end of resilient line 24 is connected in series with mooring line 27 and is also releasably attached to the case by both a first hydrostatically retractible piston assembly 84 and a corrodible pin 81. The case and anchor thus separate to the length of resilient line 24, as illustrated at position F in FIG. 1.

As the case and anchor descend through a first preselected depth, the first piston assembly 84 is actuated hydrostatically to release the resilient line. The resilient line remains attached to the case by corrodible pin 81.

The case and anchor, connected by the resilient line, descend to the ocean floor, as shown at position G. The pin dissolves over a period of time and line 27, connected in series with the other end of resilient line 24, is payed out from the case by spinning off non-rotating spool 52. The mooring line 27 may be a stranded or tubular braided steel cable of small diameter. As the mooring line pays out, the case begins to ascend.

When the case ascends to a predetermined mooring depth, the payout of the mooring line is terminated by a second hydrostatically retractible piston assembly 65 (see FIG. 3) and this results in the case being permanently tethered to the anchor by means of the mooring line, as illustrated by position I.

If the case reaches the ocean floor before passing through the preselected first depth, resilient line 24 will not be released from the case by the first piston assembly, mooring line 27 will not be payed out and the case will be tethered by only the resilient line, as illustrated at position J.

Rectangular cavity 42 is formed in the anchor to provide a clearance space between anchor 25 and case 32 when the two are assembled. Hydrostatically actuated piston assembly 84 is mounted in cavity 42. Except for cavity 42 the anchor is symmetrical in shape to avoid entangling resilient line 24 as the anchor descends.

Mine case 23 has one end 50 rigidly secured to case fairing 51. Case fairing 51 is cylindrical in shape with longitudinal axis 55 and circumferential, axially extending side or inner lip 53. The axially extending end encompassed by lip 53 is open to receive annularly shaped storage spool 52.

Storage spool 52 forms a continuous circular path radially inward of lip 53 for the storage of mooring line 27. Spool 52 has a longitudinal axis coincident with case fairing axis 55 and is secured inside the open end of case fairing 51. The open circumference of the spool extends radially away from axis 55 with curved portion 57 extending outward thus providing a curved circumferential surface for mooring line 27 to travel over as the line unwinds from the storage spool. As the mooring line pays out from the storage spool the line travels around curved portion 57 and then along the spool fairing 58 which is secured to case fairing 51 by bolts 56.

Pliant membrane 48, constructed of a rubber or soft plastic material, is attached to spool 52 opposite curved portion 57, and extends across the open circumference of the spool. The purpose of membrane 48 is to hold stored mooring line 27 in spool 52.

Fairing cover 59 parallels spool fairing 58 to form a continuous space 49. Circular frame member 70 with central hole 71 is mounted concentrically in center hole 61 of cover 59. The space 49 provides a continuous circumferential volume in which mooring line 27 may pass into and through as the line unwinds from the storage spool 52.

Frame 70 has a plurality of circumferentially spaced radially directed through holes 73 which communicate with central hole 71. A cylindrically shaped termination member 26 is slidably inserted in central hole 71. The termination member attaches resilient line 24 to mooring line 27. Termination member 26 has a plurality of half-spherical cavities 77 that are spaced circumferentially so as to align with the through holes 73.

Frame 70 has an axially outward facing concentric groove 74. Compression spring 79 is mounted in groove 74 and held in a compressed state by locking ring 78. Locking ring 78 serves to hold a plurality of balls 69 in position in through holes 73 and half-spherical cavities 77 thus securing termination member 26 to frame 70 and hence to mine case 23. Locking ring 78 has the axially inward facing surface tapered to conform in configuration to the outer tapered portion of frame member 70. When locking ring 78 is permitted to move axially outward, balls 69 move radially outward from half-spherical cavities 77 and through holes 73. The movement of balls 69 out of cavities 77 releases termination member 26 from the frame 70.

Side member 80 is attached to the radially outward surface of locking ring 78 and has a through slot 85 having an inward edge flush with locking ring 78. Frame member 70 has a cavity 86 in the outer circumference which is positioned so as to align with slot 85 when locking ring 78 is positioned to hold spring 79 in the compressed state.

Corrodible pin 81, constructed from a material such as magnesium, which reacts with seawater to dissolution, is press fit into through slot 85 and cavity 86 to retain the locking ring and spring in the compressed state. Side member 80 also has radially outward facing cylindrical cavity 82 into which pin 83 of a first hydrostatically retractible piston assembly 84 extends so as to retain side member 80 and thus locking ring 78 and spring 79 in the compressed position. It can thus be seen that corrodible pin 81 and first piston assembly 84 act as independent mechanisms for securing termination member 26 to case 23.

Figure 5:
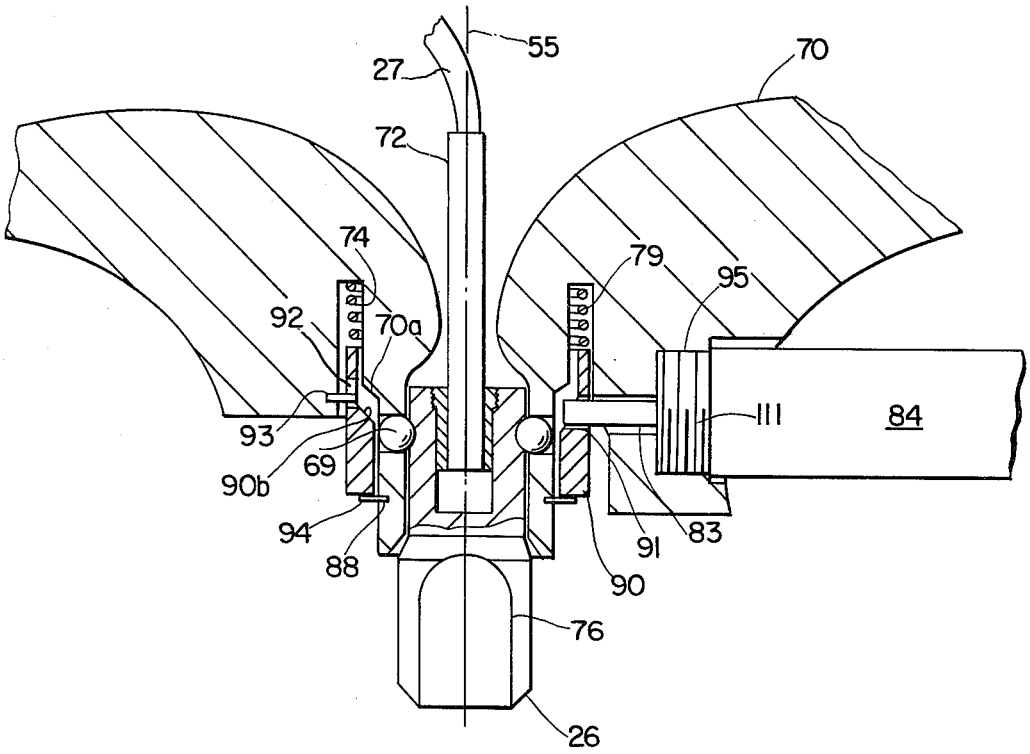
FIG. 5 shows a cross-sectional view of an alternate embodiment for securing the termination member to the case.

As seen in FIG. 5, frame 70 has a threaded cavity 95 on the axially outward facing surface. First piston assembly 84 has threaded portion 111 which enables the piston assembly to be mounted in threaded cavity 95. When the case 23 and anchor 25 are secured together, first piston assembly 84 fits in rectangular cavity 42 of the anchor.

An alternate embodiment for securing termination member 26 to case 23 is shown in FIG. 5. Side member 80 with cavity 82 has been eliminated and locking ring 78 has been replaced with hollow locking ring 90 having a through hole 91 which is engaged by retractible pin 83 of first piston assembly 84. Corrodible ring 94 is positioned in circumferential groove 88 on frame member 70 thereby forming a stop for securing locking ring 90 and spring 79 in the compressed position. Corrodible ring 94 acts independently of first piston assembly 84, thus providing two distinct and independent mechanisms for securing termination member 26 and resilient line 24 to case 23.

Each locking ring may be provided with an axially extending through slot 92 in the axially inward end, shown in FIG. 5. Frame 70 is provided with a radially inward extending pin 93 which engages the slot 92 to provide a limit to the travel of the locking rings when not secured by corrodible ring 94 or pin 81 and first piston assembly 84.

Figure 6:
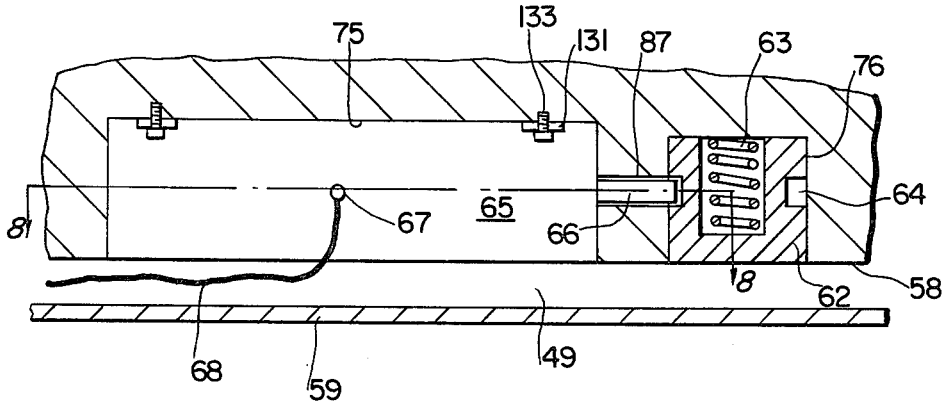
FIG. 6 shows a longitudinal cross-section of the mooring line braking structure taken along line 6—6 of FIG. 3.

Partially shown by FIG. 2 and illustrated fully by FIG. 6, cylindrically shaped pin 62 is mounted flush in cylindrical cavity 76 of reel fairing 58. Annular groove 64 is formed in the cylindrical side of pin 62. Spring 63 is mounted in cavity 76 such that the spring is inward of and compressed by pin 62, thus acting to urge the pin outward and into the space 49.

As shown in FIG. 6, pin 62 is held in the cylindrical cavity 76 against the force of spring 63, by a retractible pin 66 which engages an annular groove 64. The retractible pin 66 is attached to and operated by a second hydrostatically actuated retractible piston assembly 65. The second piston assembly 65 is mounted in cavity 75 of spool fairing 58. Cavity 75 communicates with cavity 76 by means of passage 87, so that retractible pin 66 may project into annular groove 64 of pin 62. The second piston assembly is designed to actuate upon decreasing hydrostatic pressure and retract pin 66 from ring 64 whereby spring 63 forces pin 62 outward from cavity 76 into space 49 so as to abut spool fairing cover 59 and brake the payout of mooring line 27.

Figure 3:
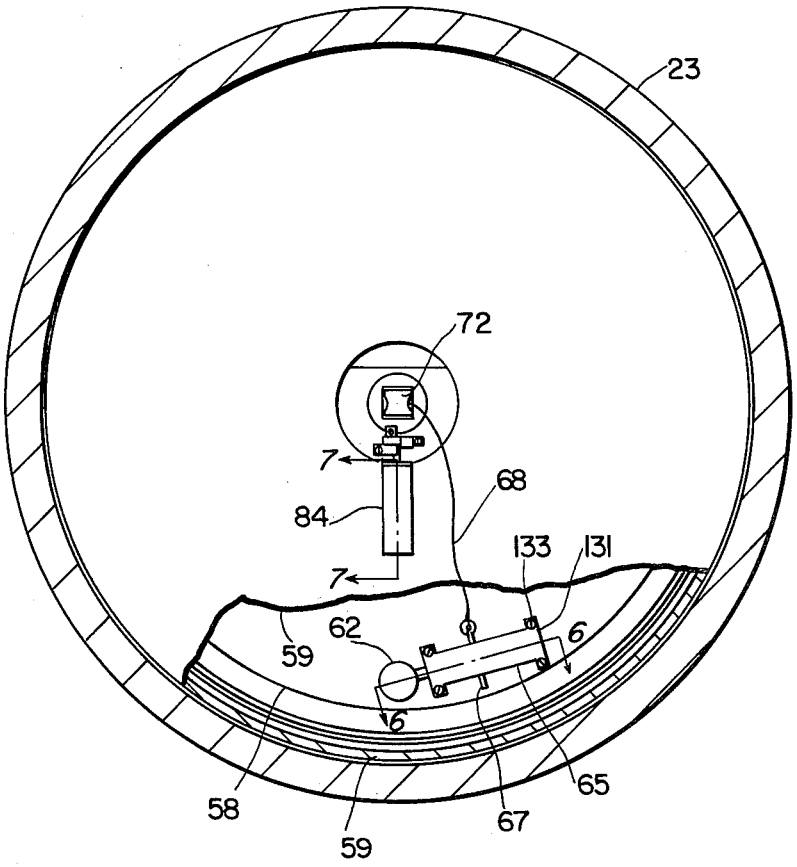
FIG. 3 shows a partial cross-section of the case revealing the mooring line braking structure.

Referring to FIG. 3, the second piston assembly 65 is secured from retracting by locking pin 67, connected by line 68 to mooring line 27. The function of locking pin 67 is to prevent piston assembly 65 from retracting until mooring line 27 begins to payout.

Figure 7:
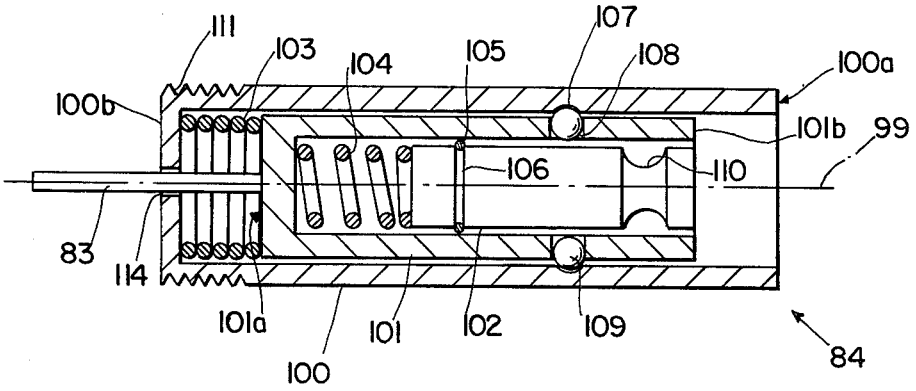
FIG. 7 shows a cross-sectional view of the first piston assembly taken along line 7—7 in FIG. 3.

As illustrated in FIG. 7, first piston assembly 84 has outer hollow cylinder 100 which is open at end 100*a* and closed at opposite end 100*b* with a through hole 114 axially centered on the closed end. A plurality of half-spherical cavities 107 are located circumferentially on the interior surface of outer cylinder 100. Inner cylinder 101 is slidably positioned in outer cylinder 100 and open at end 101*b* and closed at other end 101*a* with retractible pin 83 attached on the outer surface of the closed end. Pin 83 extends through hole 114 when the inner cylinder is slidably inserted with minimal clearance into the outer cylinder. Hole 114 allows water into the area between the outer cylinder and the inner cylinder to balance the water pressure acting on cylinder 101.

Compression spring 103 is positioned between outer cylinder 100 and inner cylinder 101. A plurality of through holes 108 are positioned around the circumference of inner cylinder 101 such that they align with a plurality of half-spherical cavities 107 positioned circumferentially around the interior surface of outer cylinder 100 when spring 103 is compressed between the outer and inner cylinders.

Piston 102 is slidably inserted into inner cylinder 101 thus securing a plurality of balls 109 in holes 108 and half-spherical cavities 107 to hold spring 103 in a compressed state. A tight seal is formed between piston 102 and the inner cylinder by resilient ring 105 mounted in circumferential groove 106 in piston 102. Compression spring 104 is positioned between piston 102 and inner cylinder 101 and is compressed by the force of the water pressure acting on piston 102.

Piston 102 is provided with annular groove 110 which is positioned on the piston such that the groove is outward of through holes 108 when there is minimal water pressure acting on piston 102. When water pressure increases, piston 102 moves inward until the groove aligns with holes 108 allowing balls 109 to be moved into the groove and allowing spring 103 to force cylinder 101 and pin 83 outward thus disengaging the pin from side member 80.

Spring 103 must have a spring force sufficient to force decompression of the spring against the mechanical friction inherent in the piston assembly so as to completely retract pin 83 when balls 109 are disengaged from half-spherical cavities 107 in outer cylinder 100. The force of spring 104 is such that it can be compressed by water pressure at a preselected depth. It can thus be seen that the force required to compress spring 104 determines the depth at which first piston assembly 84 will be actuated to release the resilient line 24.

Figure 8:
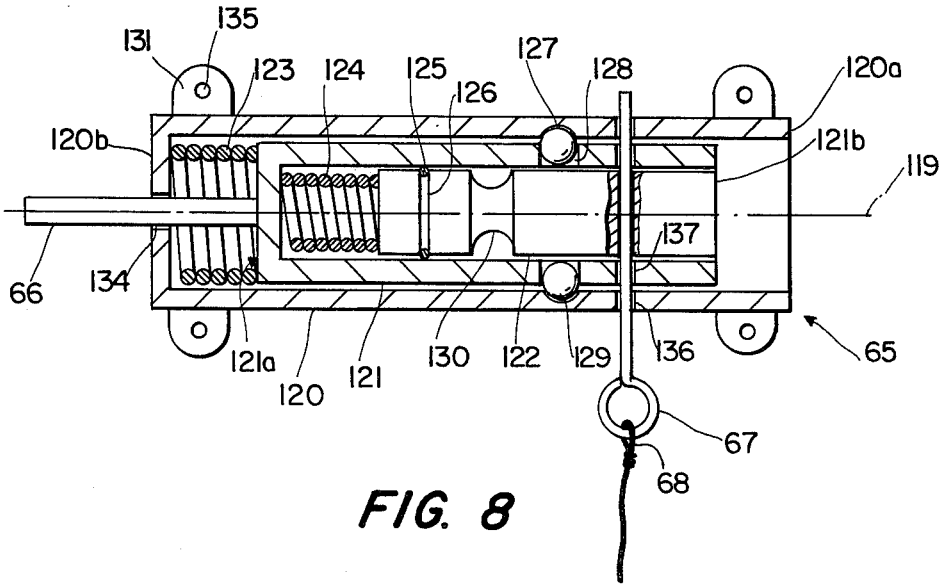
FIG. 8 shows a cross-sectional view of the second piston assembly taken along line 8—8 in FIG. 6.

As illustrated in FIG. 8, second piston assembly 65 has outer hollow cylinder 120 open at end 120*a* and closed at opposite end 120*b* with a through hole 134 centered on the closed end. A plurality of half-spherical cavities 127 are located circumferentially on the interior surface of outer cylinder 120 and two through holes 136 are positioned circumferentially on the diameter of the outer cylinder and positioned between the half-spherical cavities 127 and the open end of the cylinder.

Inner cylinder 121, is slidably positioned in outer cylinder 120 and open at end 121*b* and closed at other end 121*a* with retractible pin 66 attached on the outer surface of the closed end. Pin 66 extends through hole 134 when the inner cylinder is slidably inserted with minimal clearance into the outer cylinder. Hole 134 allows water into the area between the outer cylinder and the inner cylinder so as to balance the water pressure acting on cylinder 121.

Compression spring 123 is positioned between outer cylinder 120 and inner cylinder 121. A plurality of through holes 128 are positioned around the circumference of inner cylinder 121 such that they align with a plurality of half-spherical cavities 127 positioned circumferentially around the interior surface of outer cylinder 120 when spring 123 is compressed between the outer and inner cylinders.

Inner cylinder 121 has two through holes 137 positioned on the diameter between through holes 128 and open end 121*b*. Holes 136 of outer cylinder 120 are aligned with holes 127 of the inner cylinder 121 when spring 123 is compressed. Locking pin 67 is inserted into holes 136 and 137 to secure inner cylinder 121 and spring 123 in outer cylinder 120.

Piston 122 is slidably inserted into inner cylinder 121 thus securing a plurality of balls 129 in holes 128 and half spherical cavities 127 to hold spring 123 in a compressed state. A tight seal is formed between piston 122 and the inner cylinder by resilient ring 125 mounted in circumferential groove 126 in piston 122.

Compression spring 124 is positioned between piston 122 and inner cylinder 121 and is held in a compressed state by locking pin 67 which is inserted into aligned holes 136 and 137 thus preventing movement of the piston out of the inner cylinder.

Piston 122 is provided with annular groove 130 which is positioned on the piston such that when spring 124 is held in a compressed state by locking pin 67 the groove is inward of balls 129 which are held in holes 128 and cavities 127 by the piston.

Second piston assembly 65 is provided with tabs 131 and through holes 135 to facilitate attachment of the piston assembly in cavity 75 of spool fairing 58 by means of bolts 133.

Prior to actuation of piston assembly 65, piston 122 and inner cylinder 121 are secured to outer cylinder 120 by locking pin 67 and balls 129. After resilient line 24 has payed out and as mooring line 27 begins to payout, connecting line 68, connected to mooring line 27, is tensioned thereby pulling locking pin 67 out of aligned holes 136 and 137. The force of the water pressure, opposing spring 124, is sufficient at depths greater than the preselected mooring depth to keep the spring compressed.

As case 23 ascends, the water pressure holding spring 124 in the compressed state decreases and piston 122 moves axially toward the open end of the inner cylinder to maintain equilibrium. At the preselected mooring depth piston 122 has moved axially outward so as to permit balls 129 to move into groove 130 thereby disengaging from half-spherical cavities 127 of outer cylinder 120.

Spring 123 then forces inner cylinder 121 outward from outer cylinder 120 thereby retracting pin 66 from annular groove 64 of braking pin 62.

Spring 123 must have a spring force sufficient to force decompression of the spring against the mechanical friction inherent in the piston assembly so as to completely retract pin 66 when balls 129 are disengaged from outer cylinder 120. Spring 124 must have a spring force that is sufficient to move piston 122 the distance required to enable groove 130 to align with holes 128. It can thus be seen that the restoring force of spring 124 determines the mooring depth.

The operation of the mooring system, will now be described. After launching, case 23 and anchor 25, secured together by retaining band 40 and explosive bolt 44, assume a generally vertical position with the more buoyant case above the anchor. At either a prescribed depth, much less than the preselected mooring depth, or at a prescribed time after launching, wherein the mine is at a depth much less than the preset mooring depth, a signal is generated from within the mine or other marine device which fires explosive bolt 44 to release retaining band 40 allowing balls 43 to move out of groove 54. The difference in buoyancy between negatively buoyant anchor 25 and positively buoyant case 23 cause the two to separate thus exposing cavity 29 and unwinding resilient line 24 from cavity 29 as the case and anchor separate. The case and anchor then descend together separated by the length of the resilient line. The resilient nature of line 24 permits it to absorb much of the shock and oscillation that occurs when the line is pulled tight. When case 23 and anchor 25 separate, corrodible pin 81 is exposed to seawater whereupon corrosion of the pin commences.

At this point in the mooring procedure there are two alternative possibilities: the anchor will reach the ocean floor before it passes through the depth necessary to initiate payout of the mooring line; or the anchor will not contact the ocean floor until after it passes through the depth necessary to initiate payout of the mooring line.

In the event anchor 25 reaches the ocean floor before the necessary depth is encountered, first piston assembly 84, which is set to actuate at a set depth below the preselected mooring depth, will not operate to retract pin 83 from side member 80 of locking ring 78. Thus locking ring 78 is not permitted to slide outward to allow balls 69 to disengage from half spherical cavities 77 of termination member 26. Termination member 26 remains secured to frame 70 and hence to case 23 and mooring line 27 cannot unwind so case 23 remains tethered to anchor 25 by resilient line 24. Corrodible pin 81 will eventually dissolve, but this will not result in paying out of mooring line 27 because termination member 26 is still secured to case 23 as described above.

If case 23 does pass through the depth necessary to initiate payout of mooring line 27 before anchor 25 reaches the ocean floor, piston assembly 84, due to the increasing water pressure on piston 102, causes pin 83 to retract and disengage from side member 80 of locking ring 78. At this point, locking ring 78 is still secured to frame 70 by corrodible pin 81 and consequently case 23 and anchor 25 continue to descend coupled only by resilient line 24.

At some later time, corrodible pin 81 is dissolved by the action of the seawater such that locking ring 78 is no longer secured to frame 70 and is pushed away from frame 70 by compression spring 79 allowing balls 69 to disengage from the half-spherical cavities 77. When the balls move outward they release termination member 26 permitting it to slide out of frame 70 thus commencing payout of mooring line 27.

As the payout of mooring line 27 commences, line 68, which is connected to the mooring line, is tensioned thus pulling pin 67 which permits piston assembly 65 to retract upon decreasing water pressure thus retracting pin 66 from annular groove 64 of braking pin 62.

Compression spring 63 forces braking pin 62 outward from cavity 76 to press against spool fairing cover 59 thus interposing a barrier in space 49 to the continued unwinding of mooring line 27. Braking pin 62 stops the payout of mooring line and the transient oscillatory forces in the mooring line, caused by the abrupt stop, are dampened by resilient line 24. Case 23 is thus moored at the preselected mooring depth by mooring line 27 connected in series by resilient line 24 to anchor 25.

It is apparent that the disclosed system for mooring a mine or other marine device at a preselected depth provides a system which is simple, reliable, compact and thus able to be launched by a submerged or aerial platform and automatically moor the mine at the preselected depth. The disclosed mooring system begins the payout of mooring line at a first preselected depth, before the anchor reaches the ocean floor, and ceases payout of the mooring line at a second preselected depth.

Obviously, many modifications and embodiments of the specific invention other than those set forth above, will readily come to mind to one skilled in the art having the benefit of the teachings presented in the foregoing description and the accompanying drawings of the subject invention and hence it is to be understood that the invention is not limited thereto and that such modifications are intended to be included within the scope of the appended claims.

What is claimed is:

1. A mooring system for mooring a device in water at a preselected depth below the water surface from an anchor resting on the ocean floor comprising:

a buoyant device;

a weight defining an anchor;

means detachably securing the anchor to the device;

additional means coupling the device and anchor comprising:

a resilient line secured at a first portion thereof to the anchor;

a mooring line secured between a second portion of the resilient line and the device;

a non-rotating storage spool in the device storing the mooring line;

means positioned in the device for initiating payout of the mooring line after the device has passed a first depth; and means positioned in the device for terminating payout of the mooring line at the preselected depth to which the buoyant device has ascended and which is between the first depth and the water surface;

whereupon after launching of the device and anchor in water, the securing means detaches the anchor from the device permitting the anchor to separate from the device to the extent of the resilient line as the device and anchor descend, said initiating means permits payout of the mooring line from the storage spool after the device descends through the first depth, and said terminating means terminates payout of the mooring line and ascent of the device after the device has ascended to the preselected depth.

2. The mooring system of claim 1 wherein the device and the anchor are detachably secured by means releasable upon activation of an explosive connector.

3. The mooring system of claim 1 wherein the resilient line is secured to the mooring line by a termination member having means for detachably securing the termination member to the device.

4. The mooring system of claim 3 wherein the termination member securing means comprises a locking ring and a ball and groove fastener engaging the termination member with the device.

5. The mooring system of claim 4 wherein the termination member securing means further comprises a corrodible member securing the locking ring to the device.

6. The mooring system of claim 5 wherein the corrodible member is a ring.

7. The mooring system of claim 5 wherein the corrodible member is a pin.

8. The mooring system of claim 1 wherein the initiating means is responsive to water pressure at the first depth.

9. The mooring system of claim 1 wherein the termination means is responsive to water pressure at the preselected depth.

10. The mooring system of claim 1 wherein the device to be moored is a marine mine.

11. A mooring system for mooring a marine mine in water at a preselected depth below the water surface from an anchor resting on the ocean floor comprising:

a buoyant mine case;

a weight defining an anchor;

means detachably securing the anchor to the mine case;

additional means coupling the mine case to the anchor;

a non-rotating storage spool in the mine case storing the coupling means;

a first assembly responsive to water pressure for initiating payout of the coupling means after the case has passed a first depth; and a second assembly responsive to water pressure for terminating payout of the coupling means at a preselected depth to which the buoyant mine case has ascended and which is between the first depth and the water surface;

whereupon after launching of the mine case and anchor in water, said securing means detaches the anchor from the mine case as the mine case and anchor descend in the water, said first assembly permits payout of the coupling means from the storage spool after the mine case descends through the first depth, and said second assembly terminates payout of the coupling means and ascent of the mine case after the mine case has ascended to the preselected depth.

12. The mooring system of claim 11 wherein the means for coupling the mine case to the anchor comprises:

a resilient line secured at a first portion thereof to the anchor; and a mooring line secured between a second portion of the resilient line and the mine case.

13. A mooring system for mooring a marine mine in water at a preselected depth below the water surface from an anchor resting on the ocean floor comprising:

a buoyant mine case;

a weight defining an anchor;

means detachably securing the anchor to the mine case;

additional means coupling the mine case to the anchor comprising:

a resilient line secured at a first portion thereof to the anchor; and a mooring line secured between a second portion of the resilient line and the mine case;

means in the mine case for storing the mooring line;

a first assembly responsive to water pressure for initiating payout of the mooring line after the case has passed a first depth; and a second assembly responsive to water pressure for terminating payout of the mooring line at a preselected depth to which the buoyant case has ascended and which is between the first depth and the water surface;

whereupon after launching of the mine case and anchor in water, said securing means detaches the anchor from the case permitting the anchor to separate from the case to the extent of the resilient line as the case and anchor descend, said first assembly permits payout of the mooring line from the storage means after the mine case descends through the first depth, and said second assembly terminates payout of the mooring line and ascent of the mine case after the case has ascended to the preselected depth.

14. A mooring system as in claim 13 wherein the storage means is a non-rotating storage spool.

15. A mooring system for mooring a marine mine in water at a preselected depth below the water surface from an anchor resting on the ocean floor comprising:

a buoyant mine case;

a weight defining an anchor;

means detachably securing the anchor to the mine case;

additional means coupling the mine case to the anchor;

means in the mine case for storing the coupling means;

a first piston assembly responsive to water pressure and positioned in the mine case for initiating payout of the coupling means after the mine case has descended through a first depth;

a second piston assembly responsive to water pressure and positioned in the mine case for terminating payout of the coupling means at a preselected depth which is between the first depth and the water surface;

whereupon after launching of the mine case and anchor in water, said securing means detaches the anchor from the mine case as the mine case descends, said first piston assembly permits payout of the coupling means from the storage means after the mine case descends through the first depth, and said second piston assembly terminates payout of the coupling means and ascent of the case after the case has ascended to the preselected depth.

16. A mooring system as in claim 15 wherein the coupling means comprises:

a resilient line secured at a first portion thereof to the anchor; and a mooring line secured between a second portion of the resilient line and the mine case.

17. A mooring system as in claim 16 wherein the storage means is a non-rotating storage spool.

18. A mooring system as in claims 12, 14 or 17 wherein the mine case and the anchor are detachably secured by means releasable upon activation of an explosive connector.

19. The mooring system of claim 18 wherein the resilient line is secured to the mooring line by a termination member having means for detachably securing the termination member to the case.

20. The mooring system of claim 19 wherein the termination member securing means comprises a locking ring and a ball and groove fastener engaging the termination member with the case.

21. The mooring system of claim 19 wherein said termination member securing means further comprises a corrodible member securing the locking ring to the case.

22. The mooring system of claim 21 wherein the corrodible member is a ring.

23. The mooring system of claim 21 wherein the corrodible member is a pin.

24. The mooring system of claim 4 wherein the termination member securing means further comprises a means for limiting travel of the locking ring.

25. The mooring system of claim 20 wherein the termination member securing means further comprises a means for limiting travel of the locking ring.

* * * * *